US008210646B2

(12) United States Patent
Watanabe

(10) Patent No.: US 8,210,646 B2
(45) Date of Patent: Jul. 3, 2012

(54) LIQUID EJECTING APPARATUS

(75) Inventor: Eiichiro Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 293 days.

(21) Appl. No.: 12/751,769

(22) Filed: Mar. 31, 2010

(65) Prior Publication Data

US 2010/0253740 A1 Oct. 7, 2010

(30) Foreign Application Priority Data

Apr. 1, 2009 (JP) ..... 2009-088707

(51) Int. Cl.
*B41J 2/15* (2006.01)

(52) U.S. Cl. ..... 347/40; 347/33; 347/32; 347/68; 347/54

(58) Field of Classification Search ..... 347/40, 347/49, 20, 54, 32–34, 22, 29
See application file for complete search history.

(56) References Cited

U.S. PATENT DOCUMENTS 6,206,499 B1 3/2001 Iijima et al.
7,552,992 B2 * 6/2009 Owaki ..... 347/20
7,789,492 B2 * 9/2010 Akahane ..... 347/68
2008/0235947 A1 * 10/2008 Shibuya et al. ..... 29/890.1

FOREIGN PATENT DOCUMENTS

JP 2000-190513 7/2000

* cited by examiner

*Primary Examiner* — Matthew Luu
*Assistant Examiner* — Henok Legesse
(74) *Attorney, Agent, or Firm* — Workman Nydegger

(57) ABSTRACT

A liquid ejecting apparatus includes a liquid ejecting head having a nozzle row in which nozzles are arrayed and eject liquid. A wiping member moves relative to a nozzle-forming surface of the liquid ejecting head and wipes the nozzle-forming surface along a direction that intersects a nozzle row direction. Caulking portions are exposed to the nozzle-forming surface. Insertion portions are exposed to the nozzle-forming surface and allow positioning members to be inserted therethrough. The nozzle-forming surface includes a first region ranging from a wiping start position for the wiping member to a nozzle row forming region in which the nozzle row is formed and a second, opposite, region. A first caulking portion is formed in the first region outside the nozzle row along the nozzle row direction, and a second caulking portion is formed in the second region inside the insertion portions along the nozzle row direction.

4 Claims, 6 Drawing Sheets

LIQUID EJECTING APPARATUS

The entire disclosure of Japanese Patent Application No. 2009-88707 filed Apr. 1, 2009 is expressly incorporated by reference herein.

BACKGROUND

1. Technical Field

The present invention relates to a liquid ejecting apparatus that ejects liquid from nozzles of a liquid ejecting head such as an ink jet recording head.

2. Related Art

As a liquid ejecting head that discharges (ejects) droplets of liquid in a pressure generating chamber from nozzles by causing pressure fluctuations to the liquid, there are such examples as an ink jet recording head (hereinafter, simply referred to as a recording head) for use in an image recording apparatus such as an ink jet recording apparatus (hereinafter, simply referred to as a printer); a color material ejecting head for use in manufacturing color filters of a liquid crystal display or the like; an electrode material ejecting head for use in forming electrodes of an electroluminescence (EL) display, a surface-emitting display (field emission display: FED) and the like; a bioorganic matter ejecting head for use in manufacturing biochips (biochemical elements), and the like.

Such recording head is configured such that a nozzle forming surface is exposed from an opening portion of a cover head, and the liquid droplets converted into mist adhere onto this nozzle forming surface, following the ejection of the liquid from the nozzles. If the adhering liquid droplets are left remained, then the liquid droplets solidify in the vicinity of the nozzles, causing an ejection failure. Accordingly, a printer has been proposed, which includes a rubber-made wiper blade (wiping member) that slides on the nozzle forming surface while abutting thereon, whereby wipes away the liquid droplets adhered onto the nozzle forming surface (see JP-A-2000-190513).

However, even if the above-described wiper blade is provided, the liquid may not be completely wiped away by the wiper blade because a level difference portion is formed between the opening portion of the cover head and the nozzle forming surface. When the wiper blade attempts to wipe over the level difference portion at the time of a wiping operation, then in some case, the liquid that has remained on the level difference portion adheres onto the wiper blade to be extruded to the vicinity of the nozzles. Accordingly, in the recording head in which the level difference portion as described above is formed, a large amount of ink may undesirably remain on a nozzle plate, and in particular, on the above-described level difference portion.

SUMMARY

An advantage of some aspects of the invention is to provide a liquid ejecting apparatus capable of suppressing an occurrence of the ejection failure of liquid droplets, which is caused by the liquid droplets remaining on the nozzle forming surface.

According to an aspect of the invention, there is provided a liquid ejecting apparatus including: a liquid ejecting head that includes a nozzle row in which a plurality of nozzles are arrayed and eject liquid; a wiping member that moves relatively to a nozzle forming surface of the liquid ejecting head and wipes the nozzle forming surface along a direction that intersects a nozzle row direction; a first caulking portion and a second caulking portion respectively exposed to the nozzle forming surface; and insertion portions being exposed to the nozzle forming surface and allowing positioning members to be inserted therethrough, the positioning members determining a relative position of a flow passage member that configures the liquid ejecting head. A region of the nozzle forming surface, which ranges from a wiping start position for the wiping member to a nozzle row forming region in which the nozzle row is formed, is defined as a first region. A region of the nozzle forming surface, which is opposite to the first region while sandwiching the nozzle row forming region therebetween, is defined as a second region. The first caulking portion is formed in the first region at a position outside the nozzle row along the nozzle row direction. The second caulking portion is formed in the second region at a position inside the insertion portions along the nozzle row direction.

With this configuration, the region in the nozzle forming surface, which ranges from the wiping start position for the wiping member to the nozzle row forming region in which the nozzle row is formed, is defined as the first region, and the region of the nozzle forming surface, which is opposite to the first region while sandwiching the nozzle row forming region therebetween, is defined as the second region. The first caulking portion is formed in the first region at a position outside the nozzle row along the nozzle row direction, and the second caulking portion is formed in the second region at a position inside the insertion portions along the nozzle row direction. Accordingly, when the liquid remains in the first caulking portion at the time of wiping the nozzle forming surface with the wiping member, the remaining liquid can be prevented from adhering to the wiping member and from being extruded to the vicinity of the nozzles. Furthermore, since a large interval is provided between the positioning members in the second region, the flow passage member can be surely positioned by the insertion portions. Accordingly, an occurrence of an ejection failure of the liquid droplets, which is caused by adherence of the liquid to the nozzles, can be suppressed.

In the above-described configuration, it is preferable to adopt a configuration in which at least the first caulking portion formed in the first region fill the inside of a recessed portion formed by recessing the nozzle forming surface.

With this configuration, at least the first caulking portion formed in the first region fills the inside of the recessed portion formed by recessing the nozzle forming surface. Accordingly, the liquid less likely remain in the recessed portion, and the remaining liquid can be suppressed from being spread by the wiping member that moves on the first caulking portion formed in the first region toward the nozzle row.

In the above-described configuration, it is preferable to adopt a configuration in which the first caulking portion and the second caulking portion are formed of a resin member with which a conductive material is kneaded.

With this configuration, the caulking portions are formed of the resin member with which the conductive material is kneaded. Accordingly, static electricity on the nozzle forming surface is dissipated through the caulking portion, and effects caused by the static electricity can be prevented.

In the above-described configuration, it is preferable to adopt a configuration in which the flow passage member includes: a first plate in which the nozzles and the recessed portions are formed; and a second plate in which a flow passage communicating with the nozzles is formed, the second plate being arranged on the first plate, while the recessed portions are formed continuously from the first plate to the second plate.

With this configuration, the flow passage member includes: the first plate in which the nozzles and the recessed portions are formed; and the second plate in which the flow passage communicating with the nozzles is formed, the second plate being arranged on the first plate, while the recessed portions are formed continuously from the first plate to the second plate. Accordingly, the flow passage member can be positioned by the caulking portions when the caulking portions fill the recessed portions formed on the first and second plates, and further, a large amount of the liquid can be prevented from being left in the recessed portions.

BRIEF DESCRIPTION OF THE DRAWINGS

The invention will be described with reference to the accompanying drawings, wherein like numbers reference like elements.

DESCRIPTION OF EXEMPLARY EMBODIMENTS

A description will be made below of embodiments of the invention with reference to the accompanying drawings. Note that, although a variety of limitations are imposed on the embodiments, which will be described later, as preferable examples of the invention, the scope of the invention is not limited to aspects of the examples unless otherwise described in the following description. In the following, the case is described, where the invention is applied to an ink jet recording apparatus (hereinafter, abbreviated as a printer), which is shown in FIG. 1, as an example of a liquid ejecting apparatus according to the invention.

Figure 1:
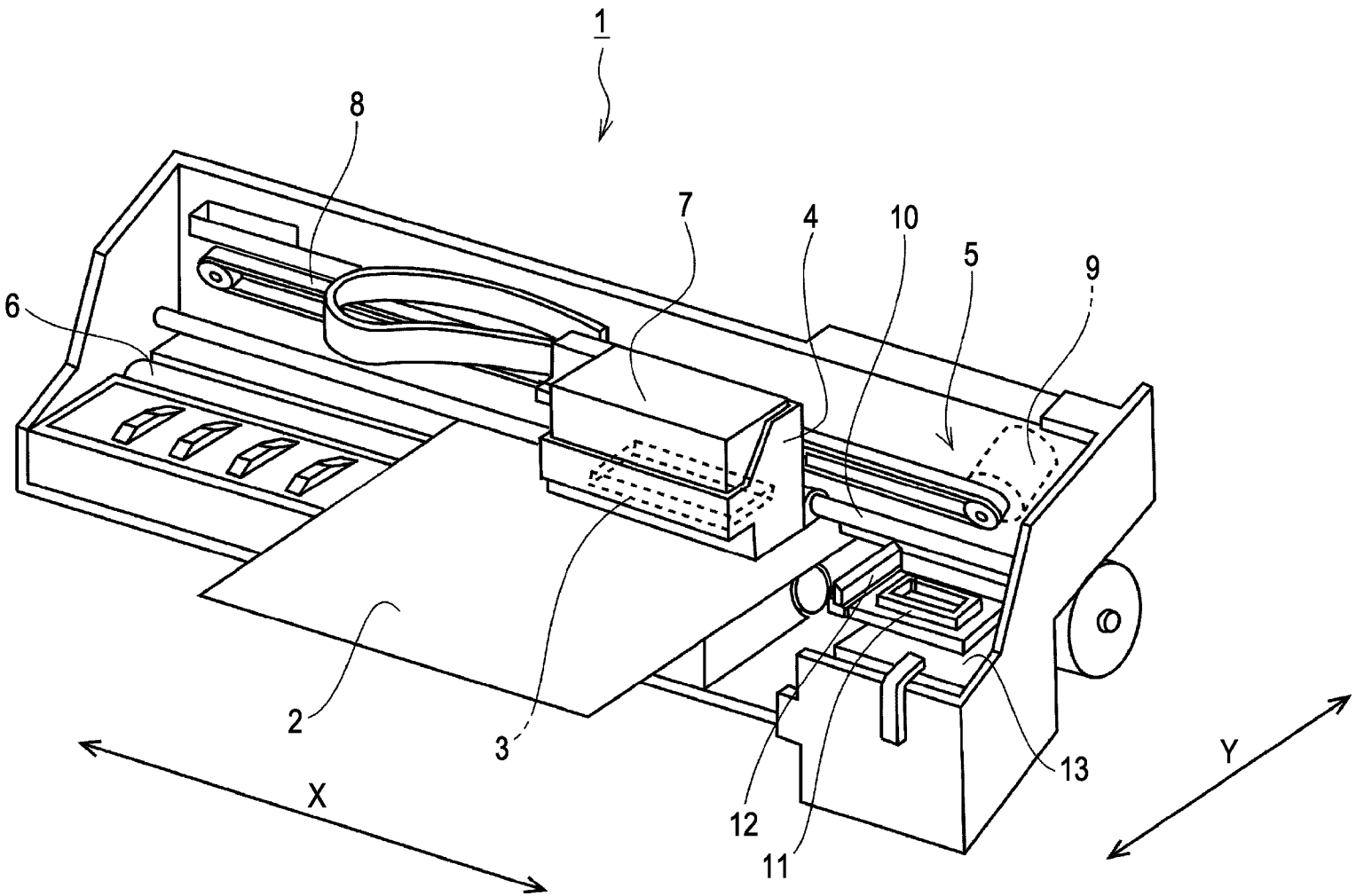
FIG. 1 is a perspective view illustrating a configuration of a printer.

FIG. 1 is a perspective view of the ink jet recording apparatus. The printer 1 is an apparatus that ejects liquid ink onto a surface of a recording medium (ejection target) 2 such as a recording sheet, thereby recording an image and the like thereon. The printer 1 includes: a recording head 3 that discharges (ejects) ink (the recording head 3 corresponds to a type of a liquid ejecting head in the invention); a carriage 4 to which the recording head 3 is attached; a carriage moving mechanism 5 that moves the carriage 4 in a main scanning direction (shown by an X direction line with both end arrows in FIG. 1); a platen roller 6 that transports the recording medium 2 in a sub-scanning direction (shown by a Y direction line with both end arrows in FIG. 1, which is perpendicular to the main scanning direction), and the like. Note that, the above-described ink is a type of liquid of the invention, and is reserved in an ink cartridge 7. The ink cartridge 7 is detachably mounted on the recording head 3.

The above-described carriage moving mechanism 5 includes a timing belt 8. The timing belt 8 is driven by a pulse motor 9 such as a DC motor. Hence, when the pulse motor 9 is actuated, the carriage 4 is guided by a guide rod 10 installed in the printer 1, and reciprocally moves in the main scanning direction X (width direction of the sheet 2).

At a home position, where recording is not performed, of the printer 1, a cap member 11 and a wiper blade 12 (a type of a wiping member in the invention) adjacent to the cap member 11 are arranged. The cap member 11 is formed in a tray shape, and abuts on a nozzle forming surface 27*a* of a nozzle plate 27 of the recording head 3. The nozzle plate 27 corresponds to a type of a first plate in the invention, and will be described later. A space inside the cap member 11 functions as a sealed space portion (not shown). The cap member 11 is configured to be in close contact with the nozzle forming surface 27*a* while causing nozzles 14 (refer to FIG. 8) of the recording head 3 to face the inside of the sealed space portion. A pump unit 13 is connected to the cap member 11, and the inside of the sealed space portion can be brought into a negative pressure state by actuation of the pump unit 13. Then, when the pump unit 13 is actuated with the sealed space portion in close contact with the nozzle forming surface 27*a* and brings the inside of the sealed space portion (hermetically sealed portion) into the negative pressure state, ink and bubbles in the recording head 3 are sucked from the nozzles 14 and are drained out into the inside of the sealed space portion of the cap member 11. In other words, the cap member 11 is configured to perform operation of forcibly sucking and draining out the ink and bubbles in the recording head 3. Hereinafter, such a sucking/draining operation will be referred to as a cleaning operation.

The wiper blade 12 wipes the nozzle forming surface 27*a* when the recording head 3 passes thereon. The wiper blade 12 is made of an elastic material such as rubber and is extended along the Y direction line with both end arrows. When the carriage 4 is moved along the guide rod 10 in a wiping direction (shown by an arrow X' in FIG. 2), i.e., a direction of the main scanning direction X, the wiper blade 12 slides a tip end edge thereof relatively to and in contact with the nozzle forming surface 27*a* of the recording head 3 and wipes away the ink and the like, which adhere to the nozzle forming surface 27*a*. Note that the printer 1 of the invention may be configured such that the wiper blade 12 moves in a direction opposite to the direction of the arrow X' while fixing the recording head 3. In other words, the wiper blade 12 needs to be configured to slide relatively to the nozzle forming surface 27*a*, and a relatively moving direction of the wiper blade in this case is the wiping direction. Note that the wiping direction X' in the invention is perpendicular to the sub-scanning direction Y.

Figure 2:
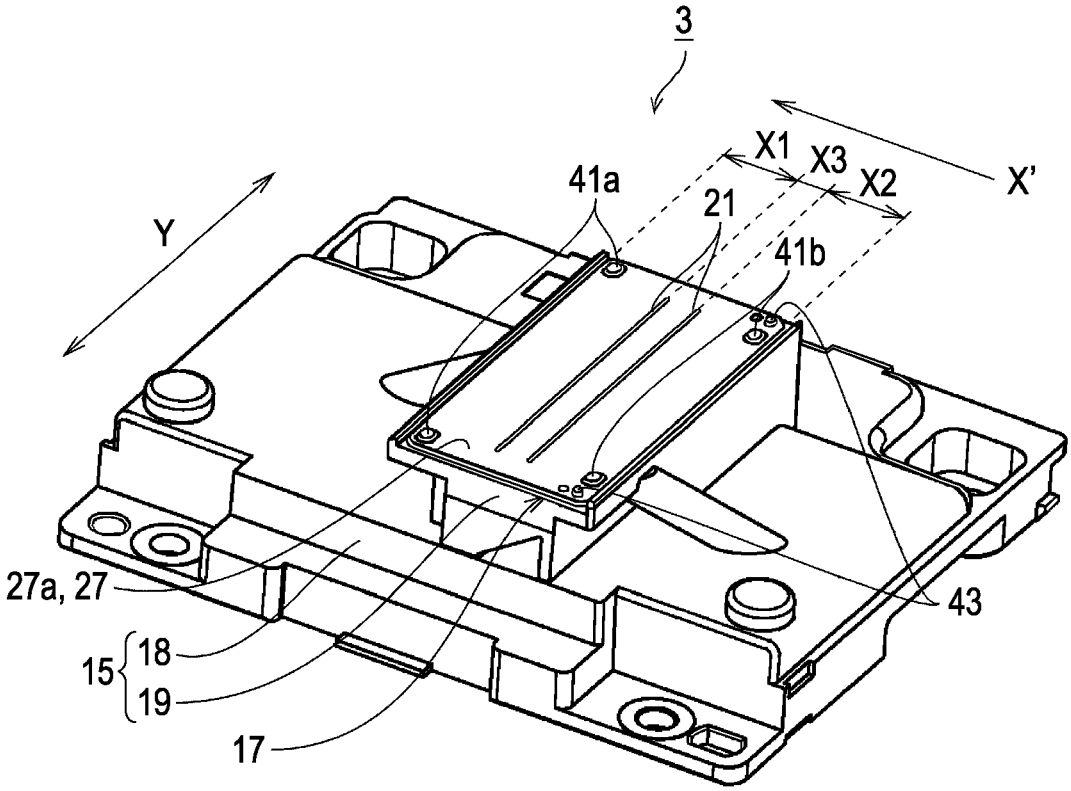
FIG. 2 is a perspective view illustrating a configuration of a recording head.
Figure 3:
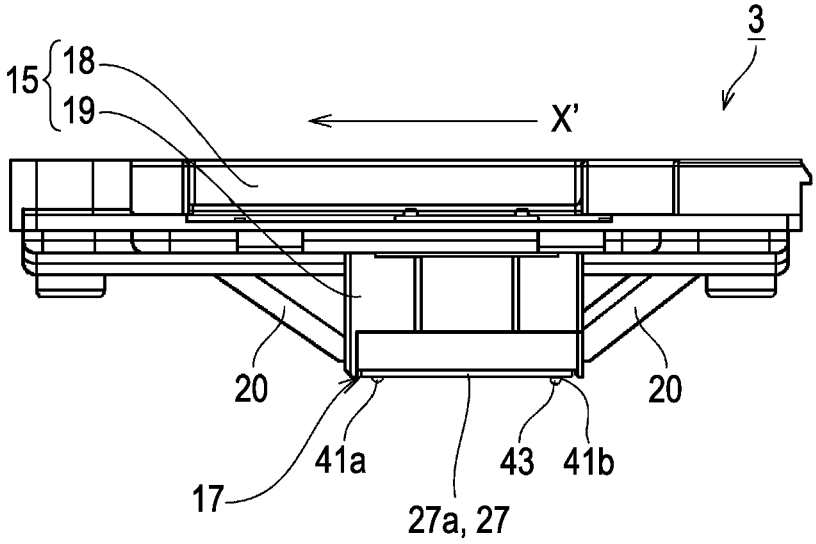
FIG. 3 is a front view illustrating the configuration of the recording head.
Figure 4:
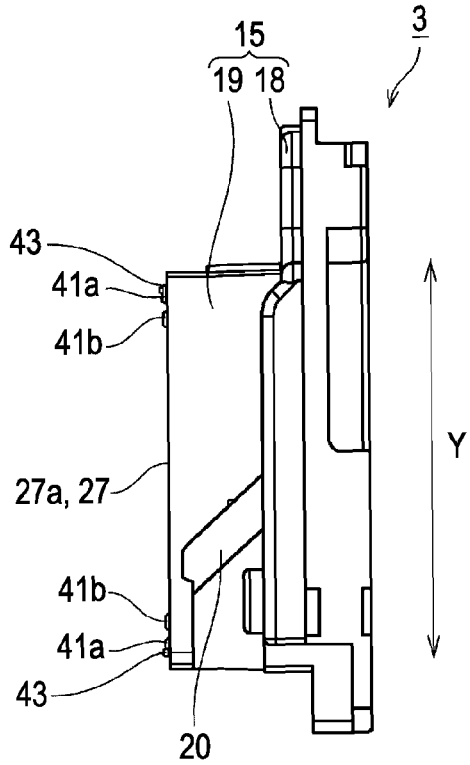
FIG. 4 is a side view illustrating the configuration of the recording head.
Figure 5:
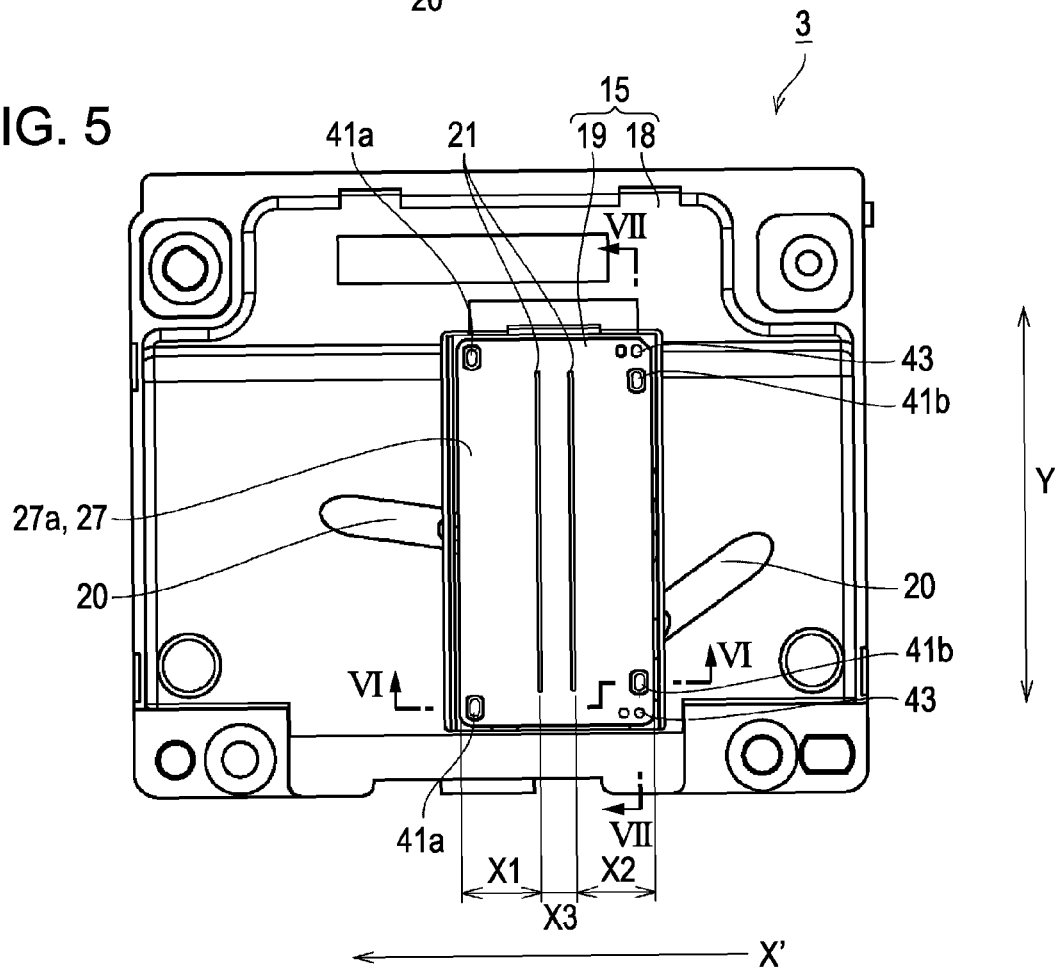
FIG. 5 is a plan view illustrating the configuration of the recording head.
Figure 6:
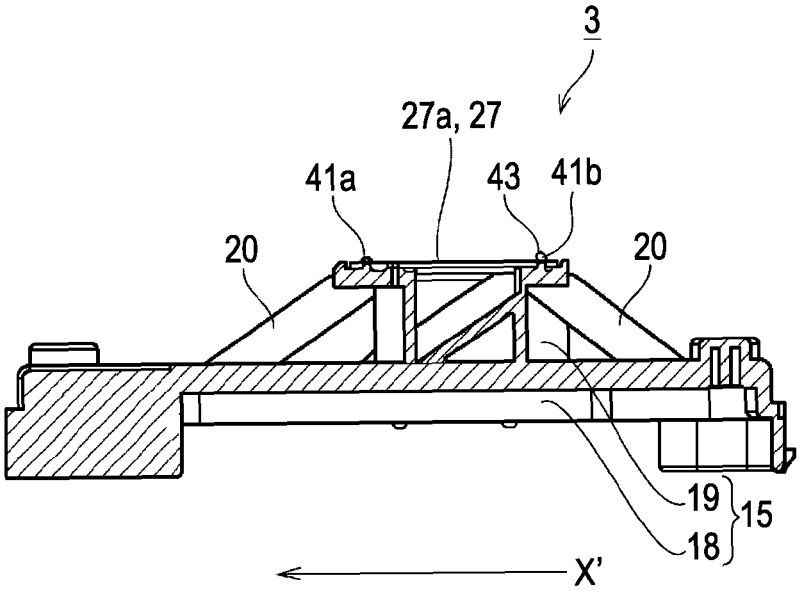
FIG. 6 is a cross-sectional view along a line VI-VI in FIG. 5.
Figure 7:
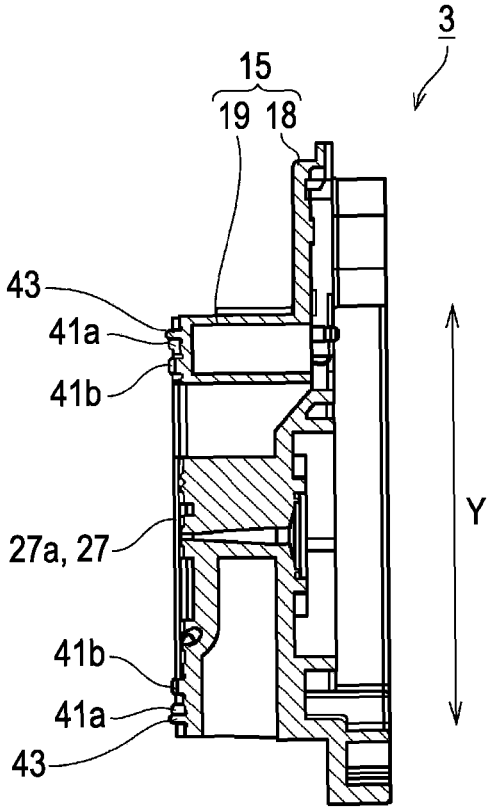
FIG. 7 is a cross-sectional view along a line VII-VII in FIG. 5.
Figure 8:
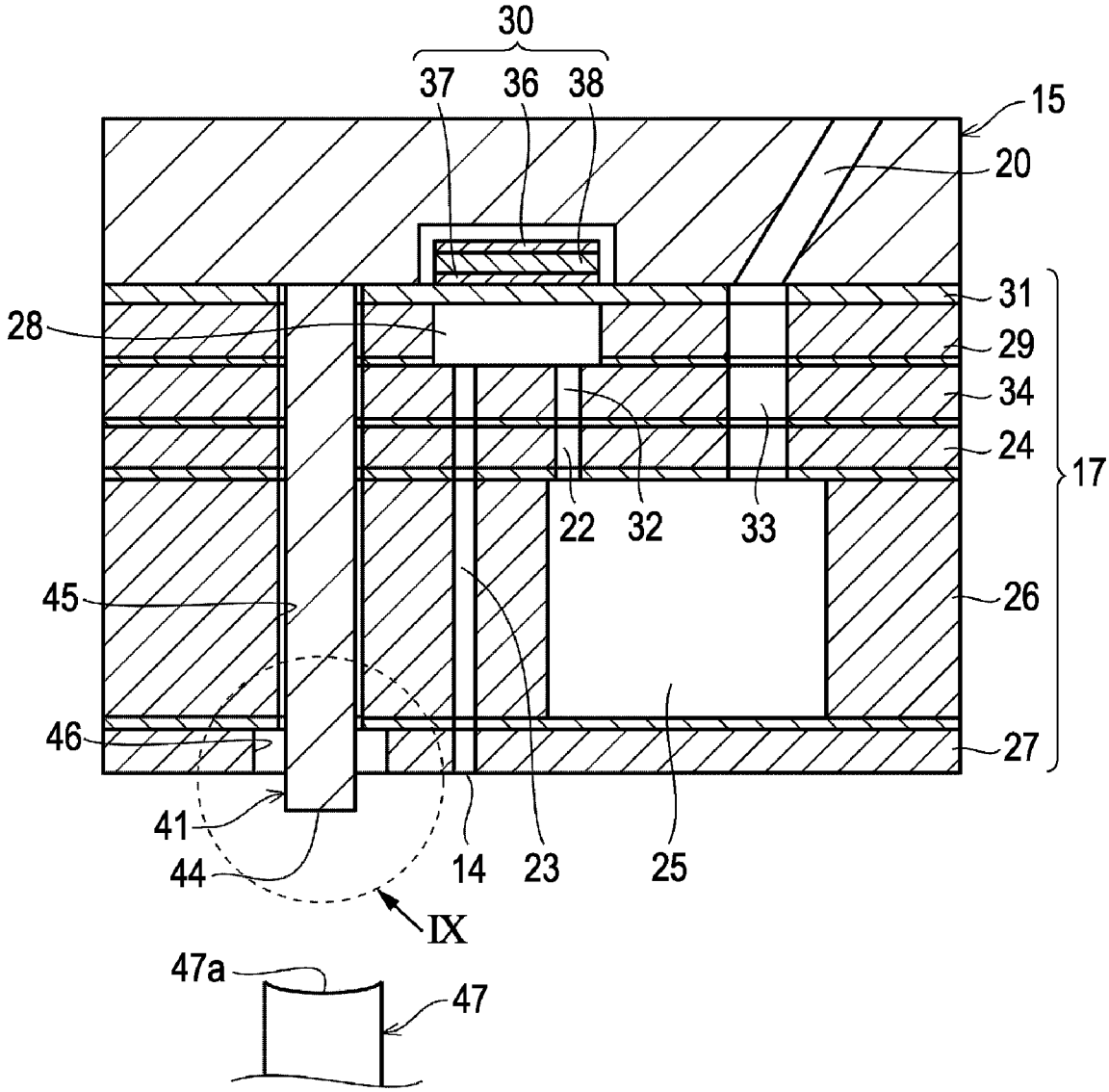
FIG. 8 is a cross-sectional view of a principal portion of the recording head.

Next, a configuration of the recording head 3 will be described. FIG. 2 is a schematic perspective view of the recording head 3 attached to the carriage 4. FIG. 3 is a front view of the recording head 3. FIG. 4 is a side view of the recording head 3. FIG. 5 is a plan view of the recording head 3. FIG. 6 is a cross-sectional view along a line VI-VI in FIG. 5. FIG. 7 is a cross-sectional view along a line VII-VII in FIG. 5. FIG. 8 is a cross-sectional view of a principal portion of the recording head 3. The recording head 3 includes: a head case 15 attached to the bottom of the carriage 4; a flow passage unit 17 (corresponding to a type of a flow passage member in the invention); an actuator (piezoelectric element) 30, and the like.

The head case 15 includes a base portion 18 and a hollow box-like case portion 19. A plurality of ink supply needles (not shown) which introduce, into the inside of the head, the ink reserved in the ink cartridge 7 and a wiring board (not shown) that applies a drive signal, sent from a printer body side, to the piezoelectric element 30 are attached to the base portion 18. The case portion 19 is protruded downward from the bottom of the base portion 18 and houses the piezoelectric element 30 therein, which will be described later. The flow passage unit 17 is attached to an opening surface of the case portion 19. In the embodiment, the head case 15 is fabricated of thermosetting resin in which a conductive material such as copper powder and carbon is kneaded into Zylon®, or the like. Moreover, the head case 15 includes a case flow passage 20 that is formed to penetrate the base portion 18 and the case portion 19 and supplies the ink to an ink flow passage in the flow passage unit 17 through the ink supply needles inserted into the ink cartridge 7. A plurality of case flow passages 20 are individually arranged for ink types (ink colors). Details of a process for attaching the head case 15 to the flow passage unit 17 will be described later.

The nozzle plate 27 is one of members which configure the flow passage unit 17. On the nozzle plate 27, the plurality of nozzles 14 are opened in rows at a pitch corresponding to a dot forming density. In the embodiment, a plurality of (two) nozzle rows 21 each including the arrayed nozzles 14 are provided in parallel to each other. The nozzle plate 27 is arranged on a side of the flow passage unit 17, which is opposite to a surface side thereof joined to the case portion 19. Note that the nozzle rows 21 of the invention are formed so that a direction thereof (hereinafter, shown by a reference symbol Y) is along the sub-scanning direction Y.

The flow passage unit 17 allows the actuator (piezoelectric element) 30 to be arranged on an upper surface (actuator mounting surface) thereof. The flow passage unit 17 includes, in a stacked state: a pressure chamber plate 29 in which through-holes serving as pressure chambers 28 are prepared; a vibrator plate 31 that has the plurality of piezoelectric elements 30 mounted thereon side by side and partitions a part of the pressure chamber 28; a communication port plate 34 in which a through hole serving as a supply-side communication port 32 and a through-hole serving as a nozzle communication port 23 are formed; a supply port plate 24 in which through holes serving as a part of ink supply ports 22 and a part of the nozzle communication ports 23 are formed; a reservoir plate 26 (corresponding to a type of a second plate in the invention) in which a reservoir 25 and a through hole serving as a part of the nozzle communication port 23 are formed; and the above-described nozzle plate 27. Note that the reservoir 25 serves as a common liquid chamber supplied with ink from the ink cartridge 7 through an ink guide passage 33 communicating with the case flow passage 20.

In the flow passage unit 17, the pressure chamber plate 29, vibrator plate 31 and communication port plate 34 are fabricated of ceramics such as alumina and zirconium oxide. The flow passage unit 17 is configured in such a manner that the pressure chamber plate 29, vibrator plate 31 and communication port plate 34 are integrated with one another by calcinations. Further, the nozzle plate 27 and the supply port plate 24 are superposed on one surface of the reservoir plate 26 and the other surface thereof, respectively, and these members are joined to one another by thermowelding films or the like. The supply port plate 24, reservoir plate 26 and nozzle plate 27 are fabricated, for example, by performing presswork of a metal plate such as a stainless steel. The flow passage unit 17 forms the ink flow passage (liquid flow passage) reaching the nozzle 14 from the reservoir 25.

The above-described pressure chambers 28 have a shape of hollow box which is long and thin in a direction perpendicular to the nozzle rows 21, and the plurality of pressure chambers 28 are formed so as to correspond to the nozzles 14. One end side of each of the pressure chambers 28 communicates with the reservoir 25 through the supply-side communication port 32 and the ink supply port 22. The other end side of the each of the pressure chambers 28, which is opposite to the supply-side communication port 32, communicates with the nozzle 14 through the nozzle communication port 23. A part of the pressure chamber 28, that is, a surface of the pressure chamber 28, which is opposite to the communication port plate 34, is partitioned by the vibrator plate 31.

In the embodiment, the piezoelectric element 30 that functions as a type of a pressure generation element is a piezoelectric element, working in a so-called flexural mode, which generates flexural vibrations in response to an electric field applied thereto. The piezoelectric element 30 is formed in a state where a piezoelectric layer 38 is sandwiched between a drive electrode 36 and a common electrode 37. Moreover, the piezoelectric element 30 is formed on a surface of the vibrator plate 31, which is opposite to the pressure chamber 28, in a state of covering the pressure chamber 28. Such piezoelectric elements 30 are arrayed in rows in the nozzle row direction Y so as to correspond to the respective pressure chambers 28. On one side of each of the piezoelectric elements 30 in a longitudinal direction, a drive terminal (not shown) is formed for each of the piezoelectric elements 30. When a drive signal is applied to a drive electrode 36 through the drive terminal, then an electric field according to a potential difference is generated between the drive electrode 36 and a common electrode 37. This electric field is applied to a piezoelectric layer 38, and the piezoelectric layer 38 is flexurally deformed in response to the intensity of the electric field applied thereto. Specifically, as a potential to be applied to the piezoelectric element 30 is raised to a positive side, the piezoelectric element 30 is displaced in a direction of approaching the flow passage unit 17, and deforms the vibrator plate 31 so as to reduce a capacity of the pressure chamber 28. Meanwhile, as the potential to be applied to the piezoelectric element 30 is dropped to a negative side, the piezoelectric element 30 is displaced in a direction of moving away from the flow passage unit 17, and deforms the vibrator plate 31 so as to increase the capacity of the pressure chamber 28. With such operation of the piezoelectric element 30, the pressure chamber 28 contracts or expands, causing pressure fluctuations in the ink in the pressure chamber 28. By using the pressure fluctuations, the ink in the pressure chamber 28 is discharged as ink droplets from the nozzles 14.

However, when the ink droplets are discharged from the nozzles 14, mist or the like of the ink droplets has sometimes adhered to the nozzle forming surface 27*a*. Accordingly, in the printer 1 of the invention, upon receiving an electric signal of wiping operation, the nozzle forming surface 27*a* of the recording head 3 is moved along the wiping direction X' with respect to the wiper blade 12. The wiper blade 12 abuts and slides on a region of the nozzle forming surface 27*a*, which ranges from a wiping start position for the wiper blade 12 to a nozzle row forming region (shown by a reference symbol X3 in FIG. 2) thereof in which the nozzle rows 21 are formed. The above-described region from the wiping start region to the nozzle row forming region corresponds to a first region in the invention, and is shown by a reference symbol X1 in FIG. 2. Thereafter, the wiper blade 12 abuts and slides on the nozzle row forming region X3, and then abuts and slides on a region (second region in the invention, which is shown by a reference symbol X2 in FIG. 2) of the nozzle forming surface 27*a*, the region X2 being opposite to the region X1 while sandwiching the nozzle row forming region X3 therebetween. Thus, the wiper blade 12 wipes the nozzle forming surface 27*a* along the wiping direction X' that intersects the nozzle row direction, thereby removing the mist of the ink droplets or the like, which are adhered to the nozzle forming surface 27*a*.

A description will be made regarding an attaching and fixing process of the head case 15 to the flow passage unit 17 in the embodiment. The above-described printer 1 includes: a first caulking portion 41 exposed to the surface 27*a* of the nozzle plate 27; and an insertion portion 43 which is exposed to the surface 27*a* of the nozzle plate 27 and has a positioning pin 42 (type of the positioning member in the invention) inserted therethrough. The positioning pin 42 determines a relative position of the flow passage unit 17. The positioning pin 42 is formed in a columnar shape, and an outer diameter thereof is set so as to match with an inner diameter of the insertion portion 43. In this embodiment, a pair of insertion portions 43 are provided at corners located in the region X2, which are among four corners of the nozzle forming surface 27*a*. The insertion portions 43 are configured so as to determine relative positions of the plates 24, 26 and 27 of the flow passage unit 17 when the positioning pins 42 are inserted therethrough.

As shown in FIG. 8, the caulking portion 41 is provided integrally with the head case 15 and configured to fix the flow passage unit 17 in such a manner that a tip end of a columnar or pin-like portion, erected toward the flow passage unit 17, of the caulking portion 41 is pressed down. In the embodiment, the caulking portion 41 is fabricated of material similar to that of the flow passage unit 17. In other words, the caulking portion 41 is fabricated of a thermosetting resin in which conductive material, such as copper powder and carbon, is kneaded into Zylon®, or the like. Accordingly, even if the nozzle plate 27 is charged with static electricity or the like, the static electricity or the like passes out to the head case side, and effects that may be caused thereby can be prevented. In this embodiment, the caulking portions 41 are arranged at the four corners of the nozzle forming surface 27*a*. To be more specific, while caulking portions 41*a* are formed in the first region X1 at positions outside the nozzle rows 21 along the nozzle row direction, second caulking portions 41*b* are formed in the second region X2 at positions inside the insertion portions 43 along the nozzle row direction.

Figure 9:
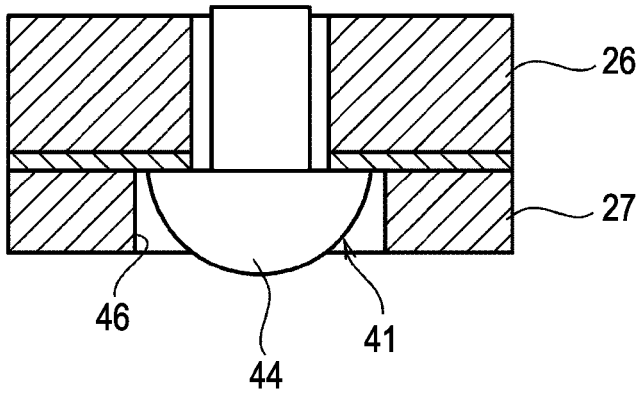
FIG. 9 is an enlarged view of a region IX in FIG. 8.

A heat tool 47 for use in crimping has a heat generation source such as an electric heater in the inside thereof, and allows a pressing surface 47*a* to protrude therefrom. The pressing surface 47*a* is formed on a tip end of a heat head of the heat tool 47. Vertical movements of the heat head are controlled by a control unit (not shown). When the heat tool 47 brings the pressing surface 47*a* near a tip end 44 of the caulking portion 41 and brings the pressing surface 47*a* in pressure contact therewith, the tip end 44 of the caulking portion 41 is heated and plastically deformed, and the tip end 44 thus deformed expands and fills the inside of a recessed portion 46. Accordingly, as shown in FIG. 9, the caulking portion 41 fixes the flow passage unit 17 to the head case 15. A process of the caulking will be described below in detail.

First, the columnar portion serving as the caulking portion 41 is inserted in order from the tip end 44 thereof into an insertion hole 45, which penetrates through the flow passage unit 17, in a state where the insertion portion 43 is positioned by the above-described positioning pins 42. Then, the tip end 44 side of the caulking portion 41 protrudes from the recessed portion 46 formed by recessing the nozzle forming surface 27*a* of the nozzle plate 27. Subsequently, the protruding tip end 44 of the caulking portion 41 is pressed and deformed by the pressing surface 47*a* of the heat tool 47 so as to increase a diameter of the tip end 44. This process is so-called heat caulking. The tip end 44 of the caulking portion 41 is deformed, whereby the head case 15 is fixed to the flow passage unit 17.

Figure 10:
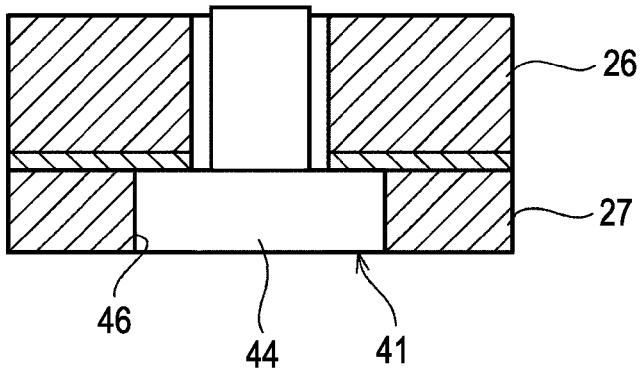
FIG. 10 is a cross-sectional view illustrating a modification example of a caulking portion.

As shown in FIG. 10, capacity of the recessed portion 46 is matched with the volume of the tip end 44 of the caulking portion 41 protruding from the recessed portion 46, and the tip end 44 is pressed by the pressing surface 47*a* of the heat tool 47, which is formed into a planar shape. The tip end 44 thus caused to be molten fills the inside of the recessed portion 46 and does not protrude to the outside of the recessed portion 46.

As described above, in the printer 1 of the invention, the caulking portions 41*a* are formed in the first region X1 of the nozzle forming surface 27*a*, which ranges from the wiping start position for the wiper blade 12 to the nozzle row forming region X3 thereof in which the nozzle rows 21 are formed. The caulking portions 41*a* described above are provided at positions outside the nozzle rows 21 along the nozzle row direction Y. Meanwhile, the caulking portions 41*b*, formed in the second region X2 opposite to the first region X1 while sandwiching the nozzle row forming region X3 therebetween are provided at positions inside the insertion portions 43 along the nozzle row direction Y. Therefore, even if the ink remains in a dent of the caulking portions 41 at the time of wiping the nozzle forming surface 27*a* by the wiper blade 12, the remaining ink can be prevented from adhering to the wiper blade 12 and being extruded to the vicinity of the nozzles 14. Further, since an interval between the positioning pins 42 is increased in the second region X2, the flow passage unit 17 can be surely positioned by the insertion portions 43. Accordingly, an occurrence of an ejection failure of the ink droplets, which is caused by the adherence of the ink to the nozzles 14, can be suppressed.

Furthermore, at least the caulking portions 41*a* formed in the first region X1 fill the inside of the recessed portions 46 formed by recessing the nozzle forming surface 27*a*. Accordingly, the ink becomes less likely to remain in the recessed portions 46, and the remaining ink can be suppressed from being spread by the wiper blade 12 that moves from the first region X1 toward the nozzle rows 21.

The invention is not limited to the above-described embodiment, and a variety of modifications are possible therefor on the basis of the description of the scope of the invention.

Figure 11:
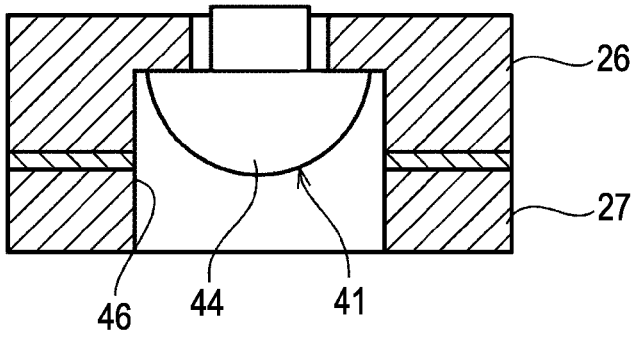
FIG. 11 is a cross-sectional view illustrating a configuration of a caulking portion according to a second embodiment of the invention.

For example, in the above-described embodiment, the configuration is illustrated, in which the inside of the recessed portion 46 formed by recessing the nozzle forming surface 27*a* of the nozzle plate 27 is filled with the tip end 44 of the caulking portion 41. However, without being limited to this, a configuration as shown in FIG. 11 may be adopted, in which the tip end 44 fills the inside of a recessed portion 46 formed by continuously recessing the nozzle plate 27 and the reservoir plate 26. Accordingly, the volume (capacity) of the recessed portion 46 is increased more than that in the above-described embodiment, and the inside of the recessed portion 46, formed by recessing the nozzle plate 27 and the reservoir plate 26, is filled with the tip end 44 of the caulking portion 41, whereby the head case 15 can be surely fixed to the flow passage unit 17.

The invention is applicable not only to the printer but also to a wide variety of ink jet recording apparatuses such as a plotter, a facsimile machine and a copier, and further to liquid ejecting apparatuses other than the recording apparatuses, for example, a display manufacturing apparatus, an electrode manufacturing apparatus, a semiconductor chip manufacturing apparatus and the like.

What is claimed is:

1. A liquid ejecting apparatus comprising:

a liquid ejecting head that includes a nozzle row in which a plurality of nozzles are arrayed and eject liquid;

a wiping member that moves relatively to a nozzle forming surface of the liquid ejecting head and wipes the nozzle forming surface along a direction that intersects a nozzle row direction;

a first caulking portion and a second caulking portion respectively exposed to the nozzle forming surface; and insertion portions being exposed to the nozzle forming surface and allowing positioning members to be inserted therethrough, the positioning members determining a relative position of a flow passage member that configures the liquid ejecting head, wherein the nozzle forming surface includes a first region ranging from a wiping start position for the wiping member to a nozzle row forming region in which the nozzle row is formed, and a second region being opposite to the first region while sandwiching the nozzle row forming region therebetween, wherein the first caulking portion is formed in the first region at a position outside the nozzle row along the nozzle row direction, and wherein the second caulking portion is formed in the second region at a position inside the insertion portions along the nozzle row direction.

2. The liquid ejecting apparatus according to claim 1, wherein at least the first caulking portion formed in the first region fills an inside of a recessed portion formed by recessing the nozzle forming surface.

3. The liquid ejecting apparatus according to claim 1, wherein the first caulking portion and the second caulking portion are formed of a resin member kneaded with a conductive material.

4. The liquid ejecting apparatus according to claim 2, wherein the flow passage member includes: a first plate in which the nozzles and the recessed portion are formed; and a second plate in which a flow passage communicating with the nozzles is formed, the second plate being arranged on the first plate, and the recessed portion is formed continuously from the first plate to the second plate.

* * * * *